United States Patent [19]

Eberle et al.

[11] Patent Number: 4,862,662

[45] Date of Patent: Sep. 5, 1989

[54] CEILING HAVING ENHANCED RESISTANCE TO FIRE

[75] Inventors: George F. Eberle, St. Louis County; Karl L. Bickel; David B. Brakeman, both of St. Charles County, all of Mo.

[73] Assignee: Alpine Engineered Products, Inc., Pompano Beach, Fla.

[21] Appl. No.: 208,476

[22] Filed: Jun. 20, 1988

[51] Int. Cl.[4] ..... E04B 5/14

[52] U.S. Cl. ..... 52/299; 52/643; 52/729; 52/515

[58] Field of Search ..... 52/372–376, 52/729, 317, 515, 639, 650, 690, 299, 643; 428/921, 351

[56] References Cited

U.S. PATENT DOCUMENTS

| | | | |
|---|---|---|---|
| 1,372,478 | 3/1921 | Bradley | 428/921 |
| 1,675,226 | 6/1928 | Munroe et al. | 52/376 |
| 3,570,208 | 3/1971 | Nikai et al. | 52/423 |
| 4,439,957 | 4/1984 | Raasakka et al. | 52/650 |
| 4,602,461 | 7/1986 | Cummins et al. | 52/639 |
| 4,669,243 | 6/1987 | Gore et al. | 52/376 |
| 4,727,700 | 3/1988 | Eberle | 52/417 |

FOREIGN PATENT DOCUMENTS

| | | | |
|---|---|---|---|
| 1504224 | 10/1967 | France | 52/729 |

*Primary Examiner*—James L. Ridgill, Jr.
*Attorney, Agent, or Firm*—Gravely, Lieder & Woodruff

[57] ABSTRACT

In a ceiling structure, wood structural components, such as wood joists or trusses, have wood shield pieces interposed between them and a sheet-like ceiling which is carried by the structural components. The shield pieces protect the structural components in the event of a fire below, in that they must be consumed by the fire before the structural components are jeopardized, and this requires additional time which extends the fire rating of the ceiling.

13 Claims, 2 Drawing Sheets

FIG. 3
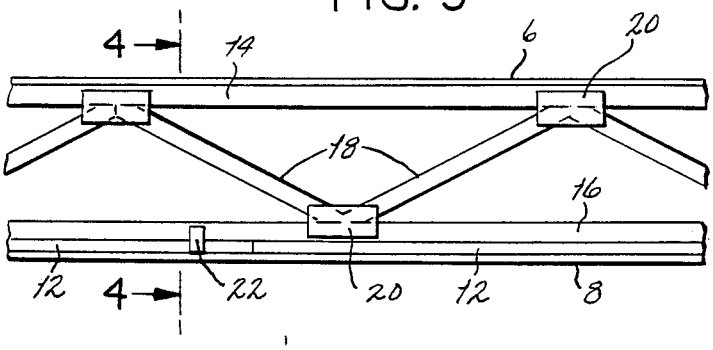
FIG. 4
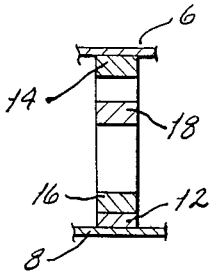
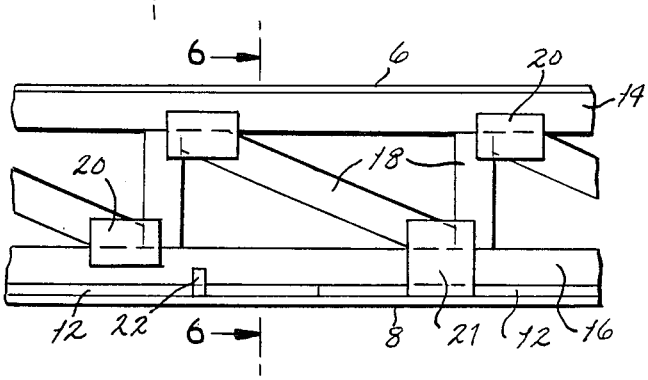
FIG. 5
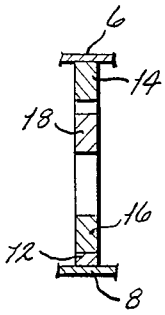
FIG. 6
FIG. 7
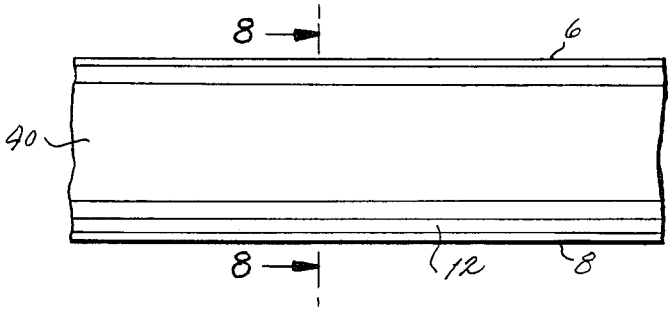
FIG. 8
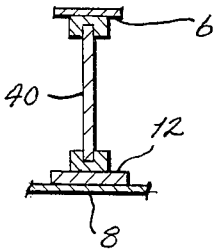
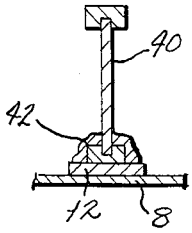
FIG. 9
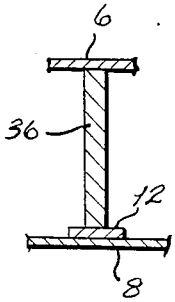
FIG. 10

CEILING HAVING ENHANCED RESISTANCE TO FIRE

BACKGROUND OF THE INVENTION

This invention relates in general to ceiling structure includings roofs and floors for buildings, and more particularly to a ceiling structure having superior resistance to fire.

Generally speaking, the portion of a building most vulnerable to a fire within the building is the ceiling structure directly above the blaze. When that ceiling structure consists of nothing more than wood joists or trusses covered with a wood subfloor, as is typical of the ceilings over the basements of many residential homes and small commercial buildings, a substantial fire in the basement would stand a good chance of setting the joists or trusses and the overlying subfloor ablaze. The joists or trusses lose strength as they are consumed, and soon the ceiling structure collapses into the basement. Unprotected wood joists or trusses usually fail within 10 to 12 minutes when subjected to the Standard Fire Test of Building and Construction Materials, ASTM Standard Designation E 119-83.

Ceiling structures which further have gypsum wallboard attached to the bottoms of wood joists or trusses fare somewhat better in fire tests, because the wallboard, being noncombustible, acts as a shield which prevents the flames from impinging directly on the joists, at least initially. Wallboard ceilings, however, consist of sheets of gypsum which abut at joints that are covered with a paper tape embedded in a joint cement. The heat of a fire destroys the bond between the joint cement and the wallboard, causing the joint cement and the tape to fall away from the wallboard to thereby expose the joint. Moreover, the heat drives the water of hydration from the gypsum of the wallboard, and this causes the wallboard to shrink and open the joints. Hot gases and flames enter the plenum region above the wallboard and soon the joists or trusses are ablaze. Also, by reason of the shrinkage, the wallboard tends to draw away from the nails or screws which attach it to the joists or trusses and in so doing loses its structural integrity in these critical regions. In time the wallboard falls, thus exposing the joists or trusses directly to the flames. A conventional wood joist or truss ceiling structure having wallboard secured directly to the bottom surfaces of its joists or trusses in the traditional manner will collapse in about one hour when subjected to the standard fire test.

Obviously, the critical component of any ceiling structure is its structural members, and this holds true irrespective of whether such members are simply board-type joists or more complex wood beams or trusses. If the structural members burn enough to lose their structural integrity, the ceiling structure which they support will collapse, and this could lead to the rapid spread of flames throughout the entire building and to the collapse of other major portions of the building.

The present invention shields wood structural members or components of a ceiling structure and thereby prolongs their structural integrity in the event of a fire below them. Yet the shield which is provided does not render the structural components any less suitable or available for hanging drywall from them, nor does it increase the difficulty of hanging such drywall. Furthermore, it does not deter or otherwise affect the placement of such structural components on support surfaces such as foundation walls or steel beams or stud walls.

DESCRIPTION OF THE DRAWINGS

In the accompanying drawings which form part of the specification and wherein like numerals and letters refer to like parts wherever they occur—

FIG. 3 is an elevational view showing one of trusses and the components supported by it;

FIG. 4 is a sectional view taken along line 4—4 of FIG. 3;

FIG. 5 is an elevational view of the ceiling structure constructed with a modified truss;

FIG. 6 is a sectional view taken along line 6—6 of FIG. 5;

FIG. 7 is an elevational view of the ceiling structure constructed with a wood I-beam;

FIG. 8 is a sectional view taken along line 8—8 of FIG. 7;

FIG. 9 is a sectional view of one of the structural members protected still further with a foam-type insulation; and FIG. 10 is a sectional view of the invention used in connection with a conventional wood-type joist.

DETAILED DESCRIPTION

Figure 1:
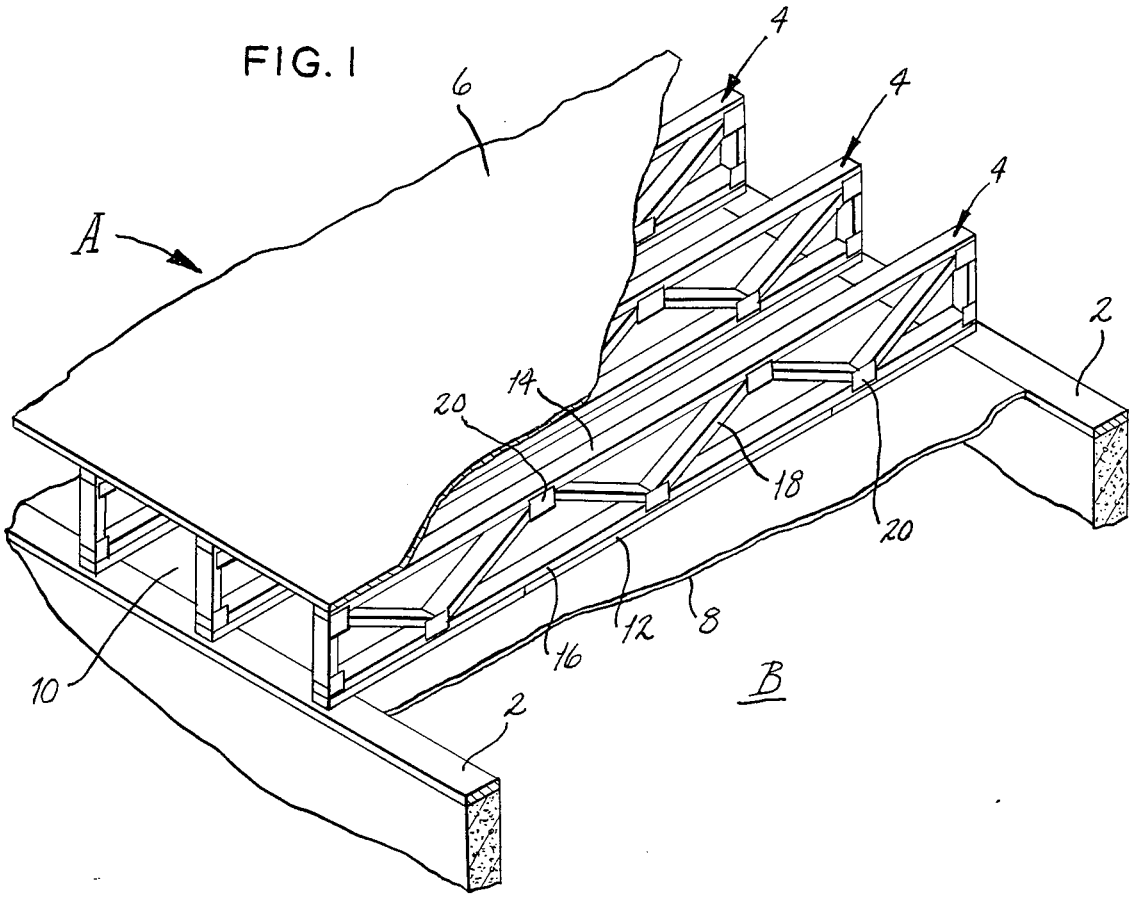
FIG. 1 is a perspective view, partially broken away, of a ceiling structure constructed in accordance with and embodying the present invention, with the perspective being from above.
Figure 2:
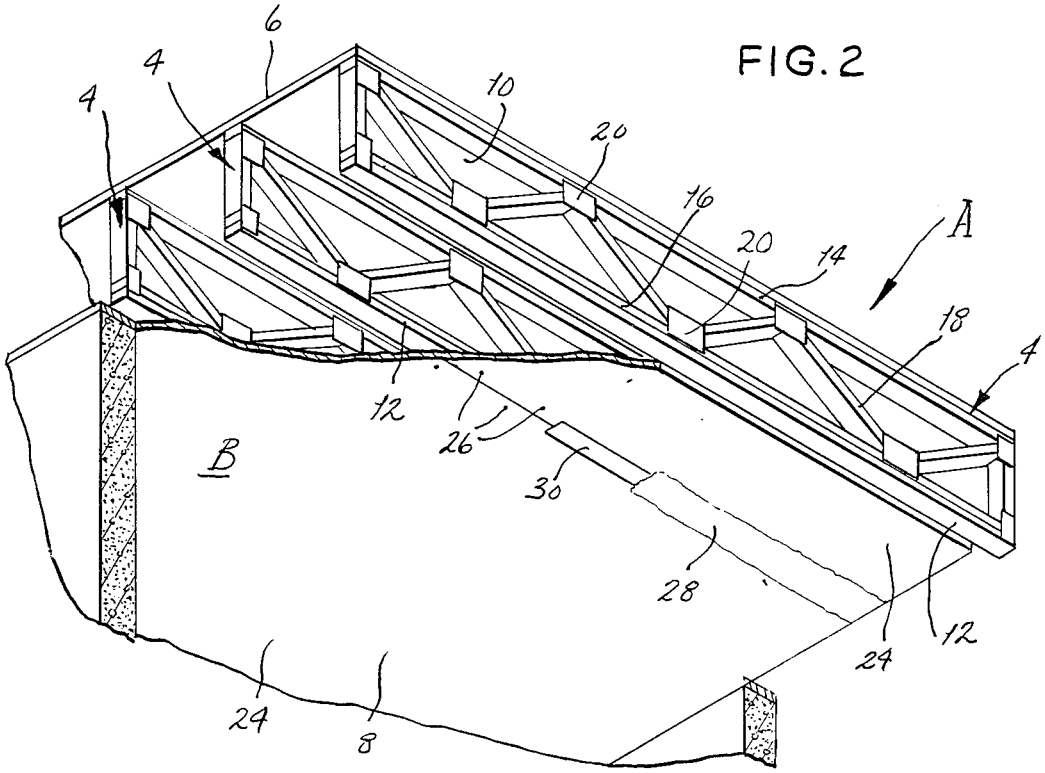
FIG. 2 is a perspective view, partially broken away, of the ceiling structure from below.

Referring now the drawings, a ceiling structure A (FIGS. 1 & 2) spans a space B between two bearing surfaces 2 which may be on a plate located along the upper surface of a foundation or other wall, or merely along the upper surface of a beam. In any event, space B is enclosed and could possibly be the source of a fire which would direct heat and flames upwardly toward the ceiling structure A. The ceiling structure A includes a series of wood trusses 4 arranged parallel to each other on predetermined centers, such as at 16 or 24 in., a sheathing 6 over the trusses, and a wallboard ceiling 8 suspended from the trusses 4. The sheathing 6 and ceiling 8 enclose a plenum 10 through which wires, ducts, and pipes may extend. In addition, the ceiling structure A includes wood shields 12 which are interposed between the bottoms of the trusses 4 and the wallboard ceiling 8.

The trusses 4 provide the ceiling structure with its structural integrity, that is to say they constitute the actual structural components of the ceiling structure A. As such, each truss 4 spans the space B, resting at its one end on the one bearing surface 2 and at its other end on the other bearing surface 2. Each truss 4 includes an upper chord 14 and a lower chord 16 as well as webs 18 interposed between the two chords 14 and 16. While the two chords 14 and 16 lie parallel to each other, the webs 18, or at least some of them, are oriented obliquely to the chords 14 and 16, but irrespective of their orientation, their ends are cut so that face-type butt joints exist at those ends. At these joints, adjacent webs 18 are joined firmly and securely together and to the chords 14, 16 by truss connector plates 20 which are driven into the sides of the webs 18 and the chords 14 and 16 where the webs 18 abut the chords 14 and 16. The plates 20 are conventional, and as such they have prongs which embed within the wood chords 14, 16 and the webs 18. The chords 14 and 16, and the webs 18 as well, may be nominal 2×4 lumber oriented either horizontally (FIGS. 3 & 4) or vertically (FIGS. 5 & 6), reference being made to the major cross-sectional axis of the lumber. Being a structural member, each truss 4 is capable of supporting a substantial load and transferring that load to the bearing surfaces 2. When the truss 4 is so loaded, its upper chord 14 exists in compression and becomes a compression member, while its lower chord 16 exists in tension and becomes a tension member.

The typical floor truss is most vulnerable to fire along its lower chord, for this chord is presented downwardly, and in the absence of a wallboard ceiling, the flames from a fire in the space B will impinge against the lower chord 16 and consume it. Since the lower chord 16 of each truss 4 carries a substantial load in tension, an impairment of the lower chord 16 in any one truss 4 may well lead to the collapse of the entire ceiling structure A.

The wood shields 12 protect the lower chords 16 of the trusses 4, particularly the lower surfaces of those chords in a sacrificial sense, that is they are presented toward the fire, and should the wallboard ceiling 8 fall from the trusses 4, they will be consumed by the fire before the fire causes any serious deterioration in the load-carrying capacity of the lower chords 16. The shield 12 for each truss 4 constitutes nothing more than a simple flat wooden board attached to the lower chord 16 of the truss 4 against the downwardly presented surface of that chord. The board of the shield 12 need not be continuous throughout the length of the lower chord 16, but instead may comprise several like boards abutted end-to-end. The board or boards of the shield 12 should be at least as wide as the lower chord 16 so that no portion of the downwardly presented surface on the lower chord 16 is exposed, and indeed the board or boards of the shield 12 may be somewhat wider than the lower chord 16 so that the shield 12 projects beyond the two sides of the lower chord 16. Preferably, the boards of any shield 12 are at least ¾ in. thick in actual dimension.

When the boards of the shield 12 in width equal the width of the lower chord 16, their sides lie flush with the sides of the lower chord 16. To attach the boards of the shield 12 to the lower chord 16 in this instance, somewhat larger than normal connector plates 21 (FIG. 5) may be used to secure the webs 18 to the lower chord 12. Indeed, these plates 21 should be long enough to project below the lower chord 16 so that its prongs embed within the sides of the shield 12 as well as within the side of the lower chord 16. As an alternative or supplement to such extended plates 21, small face connector plates 22 (FIGS. 3 & 5) may be interspersed between the connector plates 20 along the sides of the lower chord 16 and the boards of the shield 12, crossing the interface between the two and being embedded in both. As such, the boards of the shield 12 are held against the lower chord 16 at their sides. Where the boards of the shield 12 are wider than the lower chord 16, they may be attached to the lower chord 16 by nails, staples or screws driven through them and into the lower chord 16.

The trusses 4 may along their lower chords 16 rest directly on the bearing surfaces 2, and to accommodate this type of support, the shields 12 need not be cut away at the ends of the lower chords 16. Since each shield 12 is formed from the material similar to that of the lower chord 16 to which it attaches, that is conventional lumber, it will carry a compressive bearing load just as well as the truss member over the bearing surface 2. Therefore, the shield 12 may be extended to the ends of its lower chord 16, so that it too overlies the bearing surfaces 2. In that arrangement the load which is carried by the trusses 4 is transmitted to the bearing surface 2 through the wood shields 12.

The sheathing 6 is secured to the upper chord 14 of the truss 4, and it in turn supports a flooring material or roofing material, depending on the particular use to which the truss 4 is placed. On the other hand, the wallboard ceiling 8 is formed from sheets 24 of wallboard, each of which is essentially a ¼ in to ⅝ in. thick sheet of gypsum that is secured to the shield 12 with fasteners 26 (FIG. 2) in the form of nails or screws. The sheets 24 of the ceiling may be attached in one or two layers. The joints between the sheets 24 abut, and those joints that extend longitudinally of the trusses 4 lie along shields 12. In addition, the ceiling 8 includes joint cement 28 and tape 30 covering and obscuring each downwardly presented joint, with the tape 30 being embedded in the joint cement 28.

Should a fire ignite in the space B and acquire an intensity great enough to deteriorate the ceiling 8, the joint cement 28 will first come loose from the gypsum sheets 24 and drop to the floor along with the tape 30 embedded in it. This exposes the seams between adjacent sheets 24, but since some of these seams lie along the wood shields 12, the hot gases from the fire are for the most part prevented from entering the plenum 10. As the fire continues, the gypsum of the sheets 24 looses its water of hydration and tends to shrink. In so doing, it draws away from the fasteners 26 and opens the seams still further, but still the wood shields 12 are enough to keep the hot gases and flames from consuming the lower chords 12. In time the sheets 24 of the ceiling 8 become so fragile that they simply drop from the trusses 4. The flames thus enter the plenum 10, but the critical lower chords 16 are still isolated from such flames since they are protected by the shields 12. But the fire persists and eventually the shields 12 are consumed, leaving the lower chords 16 of the truss exposed. The flames then impinge directly on the lower chords 16 and eventually they are consumed, whereupon the trusses 4 give way and the sheathing 6, being supported on the trusses 4, collapses into the space B along with anything that is supported on the sheathing 6.

The foregoing sequence requires considerable time, and certainly the shields 12 extend the fire rating substantially when compared with the rating for a ceiling structure without such shields. The shields 12 accomplish this end by performing two functions. First, they serve as thermal insulators and thus maintain the lower chords 16 to which they are attached at a temperature lower than that which would otherwise be experienced. Secondly, they prevent the flames from impinging against the lower chords 16 and quickly igniting them.

The trusses need not have parallel chords, but instead each may have a horizontal lower chord and inclined upper chords as in a typical roof truss. Also, the shield 12 may be applied to other types of structural components that are traditionally used in ceilings. For example, the shields 12 may be applied to a simple board joist 36 (FIG. 10), or to a composite wood joist, or a wood I-beam 40 (FIGS. 7 & 8).

Where the shield 12 is wider than that to which it is attached, it may serve as an anchor for a foam-type insulation 42 (FIG. 9) which extends over the structural component to further isolate the same from the flames and heat of a fire in the space B beneath. The structural member to which the foam insulation provides an additional measure of protection may of course be the lower chord 16 of the truss 4, or the lower flange of the wood I-beam 40.

This invention is intended to cover all changes and modifications of the example of the invention herein chosen for purposes of the disclosure which do not constitute departures from the spirit and scope of the invention.

What is claimed is:

1. In a ceiling structure including structural components, each having a downwardly presented surface that is substantially wood, a sheathing extending over and resting on the structural components and a ceiling supported by and suspended from the structural components, whereby the sheathing and ceiling enclose a plenum, the improvement comprising: a wood shield piece interposed between each structural component and the ceiling and covering substantially the entire downwardly presented surface of its structural component so as to protect the structural component in the event of fire, each wood shield piece being essentially against the structural component beneath which it lies and further extending substantially the full length of that structural component, the wood shield pieces of adjacent structural components being separated from each other such that a substantial space exists between such shield pieces.

2. The combination according to claim 1 wherein the wood shield piece comprises several wood boards abutted end-to-end along the structural component.

3. The combination according to claim 1 and further comprising bearing surfaces on which the structural components are supported, and wherein the wood shield pieces are interposed between the bearing surfaces and the structural components so that a load carried by the ceiling structure is transferred to the bearing surfaces through the wood shield pieces.

4. The combination according to claim 1 wherein the ceiling comprises sheets of wallboard formed from gypsum; and wherein the sheets are secured to the wood shield pieces by fasteners which extend through the sheets of wall board and into the shield pieces.

5. The combination according to claim 1 wherein each structural member has a lower tension member on which the downwardly presented wood surface for the structural member exists, and the wood shield piece is attached to the tension member and is wider than the tension member so that it projects beyond both sides of the tension member.

6. The combination according to claim 5 and further comprising an insulating material located against the sides of the tension member and adjacent surfaces of the shield piece.

7. The combination according to claim 1 wherein the structural components are trusses, each having a wood upper chord on which the sheathing rests, a wood lower chord, and webs interposed between and connected to the two chords; and wherein the downwardly presented surface of wood for each structural component is on the lower chord of the truss which constitutes that structural component.

8. The combination according to claim 7 wherein each shield piece is substantially equal in width to the lower chord of the truss to which it is attached; and further comprising connector plates having prongs which are embedded in the sides of the shield piece and the sides of the lower chord on the truss to hold the shield piece on the truss.

9. The combination according to claim 7 wherein the webs of each truss are formed from wood; wherein each truss further includes connector plates which lie over the sides of the webs and chords where the webs meet the chords and have prongs which embed within the webs and chords to connect the webs to the chords; and wherein at least some of the connector plates that are along the lower chord project downwardly below the lower chord and have their prongs also embedded in the sides of the shield piece so that those connector plates hold the shield piece against the lower chord.

10. In combination with a wood truss having a lower chord and a sheet-like ceiling suspended from the lower chord, with the ceiling being presented toward a space below, the improvement comprising a wood shield piece attached to the lower chord of the truss so as to provide protection to the truss in the event of a fire, the wood shield piece being essentially against the lower surface of the lower chord so that it is interposed between the ceiling and the lower chord, the shield piece being about as wide as the lower chord, yet not any narrower than the lower chord, and extending substantially the full length of the lower chord so as to cover substantially the entire downwardly presented surface of the lower chord.

11. The combination according to claim 10 wherein the shield piece comprises a series of boards abutted end-to-end along the lower chord of the truss.

12. The combination according to claim 11 and further comprising connector plates along the sides of the lower chord and the shield piece and having prongs embedded in each to hold the shield piece against the lower chord.

13. The combination according to claim 12 wherein the truss also includes webs and at least some of the connector plates have their prongs also embedded in the webs.

* * * * *